US007204373B2

(12) United States Patent
Rosen

(10) Patent No.: US 7,204,373 B2
(45) Date of Patent: Apr. 17, 2007

(54) ANGULATED PACKAGE AND DISPLAY SYSTEM

(75) Inventor: Ian K. Rosen, North Muskegon, MI (US)

(73) Assignee: American Grease Stick Company, Muskegon, MI (US)

( * ) Notice: Subject to any disclaimer, the term of this patent is extended or adjusted under 35 U.S.C. 154(b) by 246 days.

(21) Appl. No.: 10/962,154

(22) Filed: Oct. 7, 2004

(65) Prior Publication Data

US 2005/0218092 A1 Oct. 6, 2005

Related U.S. Application Data

(60) Provisional application No. 60/521,332, filed on Apr. 2, 2004.

(51) Int. Cl.
*A47F 7/14* (2006.01)

(52) U.S. Cl. ..... 211/52; 211/72; 211/194

(58) Field of Classification Search ..... 211/49.1, 211/52, 55, 70.1, 72, 73, 183, 188, 194; 248/455, 248/45.24, 759, 760, 764, 765; 229/915, 229/917

See application file for complete search history.

(56) References Cited

U.S. PATENT DOCUMENTS

| | | | | |
|---|---|---|---|---|
| 0,781,766 | A | 2/1905 | Cawthray | |
| 0,952,302 | A | 3/1910 | Brenner | |
| 1,189,531 | A | 7/1916 | Bierwirth | 229/37 |
| 2,070,747 | A | 2/1937 | Orstrom | 229/37 |
| 2,294,641 | A | 9/1942 | Walters | 206/44 |
| 3,326,361 | A | 6/1967 | Zimmerman | 206/44 |
| 4,503,116 | A | 3/1985 | Lapidus | 428/286 |
| 4,579,232 | A | 4/1986 | Fedak | 211/50 |
| 4,796,761 | A * | 1/1989 | Hermelin | 211/11 |
| 4,801,023 | A * | 1/1989 | Ecclestone | 211/55 |
| 4,944,412 | A * | 7/1990 | Daigre | 211/11 |
| 4,962,859 | A | 10/1990 | Kump | 211/50 |
| 5,123,545 | A * | 6/1992 | Hickman | 211/59.2 |
| 5,161,699 | A * | 11/1992 | Hanna et al. | 211/130.1 |
| 5,257,734 | A | 11/1993 | Bartle | 229/109 |
| 5,344,004 | A | 9/1994 | Meyer | 206/45.25 |
| 5,542,551 | A * | 8/1996 | Smith | 211/50 |
| 5,620,103 | A * | 4/1997 | Vlah et al. | 211/55 |
| 5,720,428 | A | 2/1998 | Jensen | 229/104 |
| 5,899,329 | A | 5/1999 | Hu et al. | 206/376 |
| 5,915,571 | A * | 6/1999 | Czalkiewicz et al. | 211/55 |
| 6,186,343 | B1 * | 2/2001 | Brown | 211/40 |
| 6,227,384 | B1 * | 5/2001 | Saylor et al. | 211/50 |
| 6,612,483 | B2 | 9/2003 | Harris et al. | 229/104 |
| 6,805,249 | B1 * | 10/2004 | Houle | 211/40 |
| 6,948,625 | B2 * | 9/2005 | Keberlein | 211/50 |
| 6,955,268 | B2 * | 10/2005 | Waldron | 211/51 |

* cited by examiner

*Primary Examiner*—Jennifer E. Novosad
(74) *Attorney, Agent, or Firm*—Van Dyke, Gardner, Linn & Burkhart, LLP

(57) ABSTRACT

A product display system includes a support, at least one illumination source positioned substantially above the support and operable to illuminate the support, and a plurality of product packages positioned on the support. The packages may have at least one tab extending generally downwardly from the front wall or opposite side walls. The tab angles or tilts the package relative to the support such that the package is tilted toward the illumination source. The packages are tilted such that the front walls of the tilted packages face at least partially toward the illumination source to provide enhanced illumination of the front walls of the tilted packages. The plurality of packages may be arranged in rows on a shelf, with the rows of packages being nested together.

17 Claims, 5 Drawing Sheets

ANGULATED PACKAGE AND DISPLAY SYSTEM

CROSS REFERENCE TO RELATED APPLICATION

The present application claims the benefit of U.S. provisional application Ser. No. 60/521,332, filed Apr. 2, 2004, which is hereby incorporated herein by reference in its entirety.

FIELD OF THE INVENTION

The present invention relates generally to containers or packages or boxes for products, such as breakfast cereal, crackers, cookies, toothpaste, boxed powder soap, and the like, and, more particularly, to containers or packages or boxes of such products placed on shelves for viewing and purchasing by a customer at a grocery store or the like.

BACKGROUND OF THE INVENTION

Packaged goods, such as are typically packaged in rectangular boxes, are typically placed on generally horizontal shelves within a grocery store or the like, such as self-service retail stores or the like. Typical products in such packages on the shelves in retail stores contain or include, for example, toothpaste, boxed powder soap, breakfast cereals, cookies and crackers or the like. Typically, these packages are placed in rows on the shelves and are placed adjacent to other choices or brands of similar products. The boxes include facings with text and graphics or the like to communicate to the shoppers what is in the boxes and any other information about the products in the boxes. The rectangular boxes of similar products are typically generally the same shape, and seek to achieve distinction in the selection process of the consumer through various characteristics, such as brand identification, special product offers or other offers on the package, color attraction, value of benefits and the like, that are visible or viewable at the product package and that may encourage the shopper to select one brand of product over another.

As the consumer patrols the aisles of the store for their groceries or other items, the consumer will look at the products along the shelves of the aisles and select a desired product or often a product that catches his or her attention better than other products in that aisle. Because such products are often purchased on impulse, and with little prior thought or planning on the part of the consumer, it is often desired to distinguish the packages from one another to improve the chance that a consumer will notice and select a particular package over the others on the shelves. Any competitive advantage or enhancement to the appearance or distinction from one product to another may significantly increase the likelihood that a consumer will select the enhanced or distinct product package over the other products and packages along the shelves.

Therefore, there is a need in the art for a package that will have enhanced visual appeal to further distinguish it from the other packages on the shelves.

SUMMARY OF THE INVENTION

The present invention provides an angulated or tilted container, such as a box or other type of container or package, that includes a tab or member or support along a lower edge of the front face of the container to lift or support or raise the front portion of the container upward and, thus, tilt the container rearward to enhance the visibility and appearance of the front face of the container to a consumer walking down the aisle of a store along or adjacent to shelves containing such containers or packages. Because the containers may be tilted to direct the front face of the container at least partially upward, the containers or packages or boxes of the present invention are better illuminated by the overhead lighting in the store and, thus, are further enhanced and distinguished from the other generally vertically oriented containers or packages on the shelves. This is because the viewing angle of the tilted packages at shelves or supports below eye level is adjusted to be close to 90 degrees by the angling of the packages upward and toward the eye level of the consumers.

According to an aspect of the present invention, a product display system for displaying product packages includes at least one generally horizontal shelf and at least one illumination source positioned substantially above the shelf and operable to illuminate the shelf. The display system includes a plurality of product packages positioned on a support surface of the shelf. The packages are tilted such that the front walls of the front row of packages face at least partially upward toward the illumination source to provide enhanced illumination of the front walls of the packages.

The packages may comprise rectangular boxes having a front wall, a rear wall opposite the front wall, opposite side walls, an openable top and a bottom opposite the top. The packages include at least one tab or support extending generally downwardly from the front wall and/or the opposite side walls. The tab or tabs raise the front wall of the rectangular box upward above the shelf such that the package is tilted. The packages may be arranged in rows on the support surface, with the rows of packages being nested together with the front walls of a rearward row of packages being generally adjacent to the rear walls of a forward row of packages.

Optionally, the display system may include at least one elevated, generally horizontal shelf positioned above the shelves with the rearwardly tilted boxes. The elevated shelf may support a plurality of the product packages on a support surface of the upper or elevated shelf. The product packages on the elevated shelf may be arranged in rows and tilted such that the rear wall or face of a front row of packages faces outwardly from the shelf and at least partially downward toward an eye level of a person viewing the shelf and the product packages. The display system thus may provide enhanced illumination of product packages at or below eye level, while angling packages above eye level downward toward the person viewing the packages to further enhance viewing of the packages positioned on the upper shelves in the store.

The packages or containers or boxes may also include a rear tab extending generally horizontally and rearward from a lower end of the rear wall of the packages to support the packages and limit rearward tilting of the packages on the shelves. The rear tabs may include alignment tabs or ridges extending generally upward therefrom, while the front tabs may include alignment notches for receiving the alignment tabs of the rear tabs when the packages are nested together on the support surface.

Optionally, the display system may include an angled support surface insert or tray that is positionable on a generally horizontal support or shelf. The angled insert includes at least one angled support surface for supporting at least one container at an angle relative to the generally horizontal support or shelf.

Optionally, the packages may comprise hanging packages that hang from a plurality of rods or supports or pegs, such as via insertion of a rod or peg through an aperture in a header portion of the package. The header portion may include a biasing or tilting tab at the aperture and that extends partially across the aperture. The tab engages the rod or peg when the rod or peg is inserted through the aperture and biases the header portion and package toward an angled or tilted orientation, with the front face of the package facing partially upward to enhance viewing of the package.

According to another aspect of the present invention, a method of displaying product packages at a store includes providing at least one generally horizontal support and providing at least one illumination source substantially above the support and operable to illuminate the support. A plurality of product packages are positioned on the support. The packages are tilted rearwardly with the front walls or faces of the front row of packages facing at least partially upward toward the illumination source to provide enhanced illumination of the front walls of the packages.

The packages may comprise generally rectangular boxes arranged along a support or shelf, and may include at least one tab extending generally downwardly from a front wall of the package or from opposite side walls of the package. The packages are arranged in rows on the support with rows of packages being nested together with the front walls of a rearward row of packages being generally adjacent to the rear walls of a forward row of packages. The tab raises the front wall of the package upward above the shelf such that the package is tilted rearwardly, with its front wall or face directed partially upward toward the illumination source.

Optionally, the packages may comprise hanging packages that hang from a plurality of rods or supports or pegs, such as via insertion of a rod or peg through an aperture in a header portion of the package. The header portion may include a biasing or tilting tab at the aperture and that extends partially across the aperture. The tab engages the rod or peg when the rod or peg is inserted through the aperture and biases the header portion and package toward an angled or tilted orientation, with the front face of the package facing partially upward to enhance viewing of the package.

Therefore, the present invention provides an angulated package or box or container and a system and method for displaying such packages or boxes or containers. The containers may be tilted to provide enhanced viewing of the front wall or face of the containers. The tilted containers may be nested together on a shelf to minimize the space required for the containers while still providing the enhanced viewability of the containers. The containers may be reversed, such as on upper shelves, to angle or tilt the containers to face generally downwardly toward the eye level of a person standing in the aisle next to the shelves. The containers may be maintained in a generally aligned and nested position via alignment tabs at the containers or at the support or tilting tabs of the containers. Because the containers may be angled to be directed generally upwardly toward a light illumination source in the store, the face of the containers may be better illuminated than the faces of conventional, generally perpendicular boxes, and thus may provide brighter colors and graphics to enhance the distinction of the product package relative to the other packages or boxes or containers on the shelves.

These and other objects, advantages, purposes and features of the present invention will become apparent upon review of the following specification in conjunction with the drawings.

BRIEF DESCRIPTION OF THE DRAWINGS

FIG. 1C is an enlarged view of another angling tab for a hanging container of the present invention.

DESCRIPTION OF THE PREFERRED EMBODIMENTS

Figure 1:
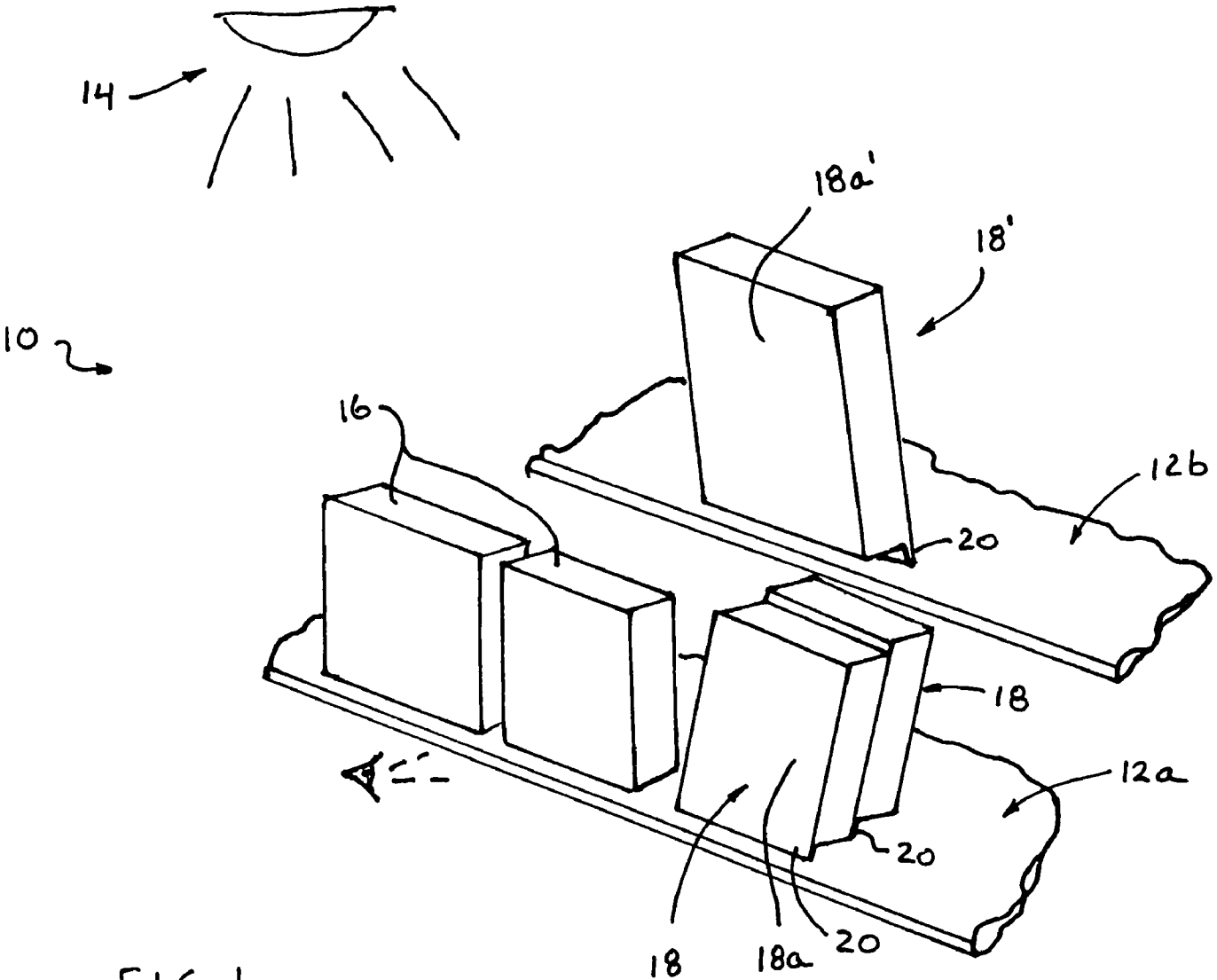
FIG. 1 is a perspective view of a product display system in accordance with the present invention.

Referring now to the drawings and the illustrative embodiments depicted therein, a product display system 10 includes a plurality of supports or shelves 12*a*, 12*b* extending generally horizontally and along an aisle or walkway in a store or retail establishment or the like (FIG. 1). The product display system 10 includes an illumination source or light or overhead lighting device 14 positioned above the shelves, such as at the ceiling or the like of the store. Illumination source 14 is operable to direct illumination generally downwardly to illuminate the shelves and the products and packages positioned thereon. The shelves may support a plurality of conventional rectangular boxes 16 and a plurality of angulated or tilted boxes or containers 18. Angulated boxes 18 are supported on the shelves and may be tilted generally rearwardly, such that a forward face 18*a* of the box 18 is directed generally outwardly from the shelf and partially upwardly and partially toward the illumination source 14. Optionally, an angulated box 18' may be positioned on an upper support or shelf 12*b* and tilted such that a rearward face or wall 18*a*' of angulated box 18' is directed generally outwardly from the shelf and partially downwardly toward the eye level of a person below the shelf 12*b* and viewing the packages or boxes on the shelves. The boxes 18, 18' may be nested together on the shelves to minimize the space required for the boxes on the shelves. The angled or tilted boxes of the present invention thus provide for enhanced viewing of the boxes while taking up little or no additional space than is typically occupied by conventional rectangular boxes. The present invention thus substantially distinguishes the containers of some products relative to other known or conventional containers, and thus enhances the likelihood that a consumer will select the enhanced or distinguished or distinct container over other containers positioned along the shelves or aisles of the store.

Figure 2:
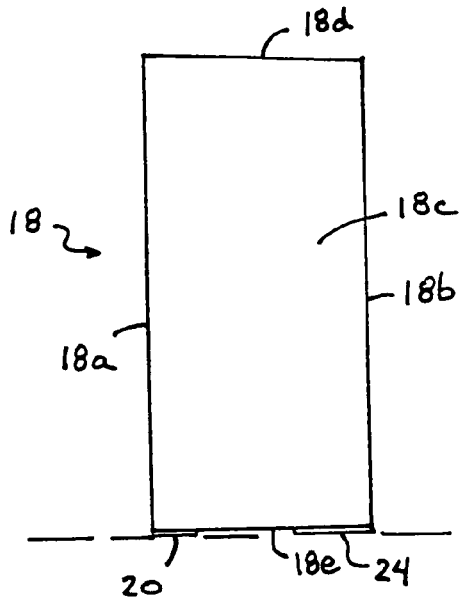
FIG. 2 is a side elevation of a container in accordance with the present invention, with the tab or tabs folded to be positioned generally under the container.
Figure 4:
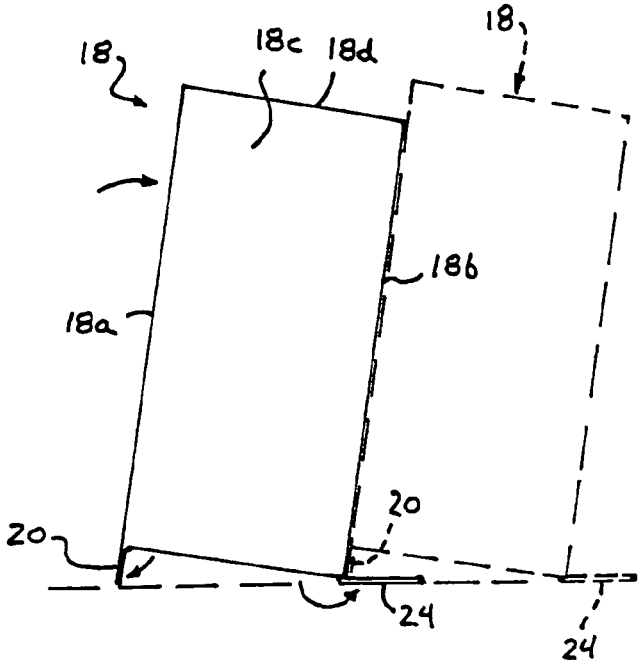
FIG. 4 is a side elevation of a pair of containers of the present invention, shown generally nested together on a shelf.
Figure 3:
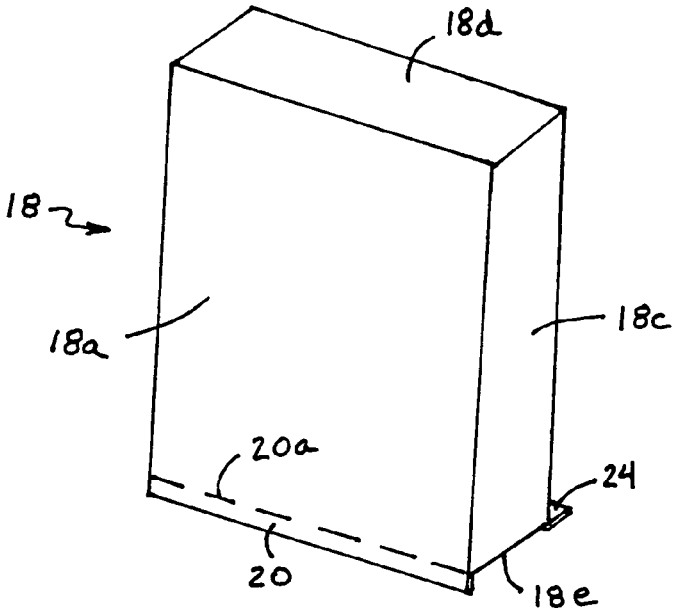
FIG. 3 is a perspective view of the box of FIG. 2, with the tabs extended to tilt the container generally rearwardly.

In the illustrated embodiment, and as best shown in FIGS. 2–4, angulated container or box 18 comprises a generally rectangular shaped box having a front wall or face 18*a*, a rear wall or face 18*b* and opposite side walls 18*c*. Angulated box 18 further includes an openable top 18*d* and a bottom panel or wall 18*e*. The rectangular shaped box may include a sealed or sealable pouch or packet (not shown) for containing the product therein. For example, the box may contain a plastic or foil pouch or tube, with the product, such as breakfast cereal, cookies, crackers, powdered soap, toothpaste and/or other products typically packaged in boxes or the like and sold at grocery stores or other retail stores or the like, contained within the sealed pouch or tube within the box.

Angulated box 18 further includes a tab or extension 20 that may extend downwardly from the front panel or face 18*a* of box 18, in order to raise the front panel 18*a* upward relative to the shelf that supports the box, such that the box is tilted or angled generally rearwardly as can be seen in FIGS. 3 and 4. As shown in FIG. 2, tab 20 may initially be folded under box 18 and along the bottom panel 18*e* of box 18, such that multiple boxes 18 may be packaged together in large containers or boxes without taking up additional space within the large shipping containers. When the boxes are to be unloaded or unpackaged and placed on the shelves, tab 20 may be folded downward (as can be seen in FIG. 4), such that the box 18 is tilted rearward when placed on the shelf. The flap or skirt or tab may be folded back under the box by the consumer after purchasing the package so that the box or container may stand generally upright when on the shelf or counter of the consumer's home.

Figure 5:
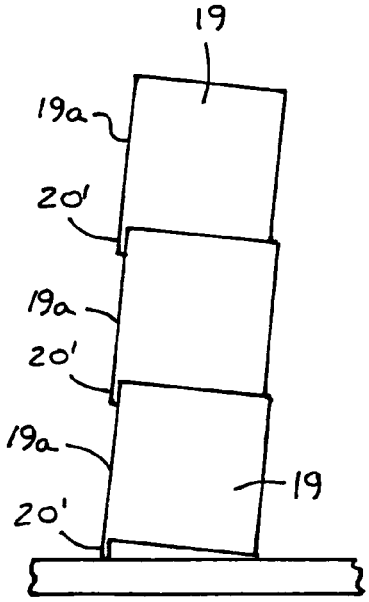
FIG. 5 is a side elevation of other containers stacked on top of one another in accordance with the present invention.

Optionally, the flap or skirt or tab along the front and/or sides of the box or container or package may assist in bracing or aligning the packages when the packages are vertically stacked upon one another. For example, and as shown in FIG. 5, one or more tabs 20' at the front of a container or box 19 may extend downward from the front of an upper box and may overlay an upper front portion 19*a* of a lower box when the upper box is stacked on the lower box. The tabs thus may overlap the lower box to retain the upper box on the lower box and to brace the upper box and limit or substantially preclude rearward sliding of the upper box relative to the tilted lower box. Such an arrangement may be suitable for packages that are often stacked on top of one another, such as small packages, such as boxes that contain tubes of toothpaste or the like.

Optionally, the flap or skirt or tab may be removably attached to the box or container, so that the flap or skirt or tab may be readily removed from the container by the consumer after purchasing the package. For example, the flap or skirt or tab may be perforated along the lower corner or edge of the container, and may be removed from the container by tearing or cutting along the perforated line (such as along the dashed line 20*a* in FIG. 3). The flap or skirt or tab may be otherwise removably attached to the container, such as via adhesive or tape or the like, without affecting the scope of the present invention. This allows the box to be displayed at an angle in the store, but also allows a consumer to readily remove the angling tab or tabs so that the box may be generally upright or vertical when placed on a shelf at the consumer's home.

In the illustrated embodiment, tab 20 is integral with the front wall 18*a* and extends downwardly therefrom when unfolded or pivoted to its extended position. Preferably, tab 20 is positioned along bottom panel 18*e* and is not part of (or not a substantial part of) bottom panel 18*e*, such that when tab 20 is unfolded or extended, there still exists the cardboard bottom panel at the location where the tab 20 was initially positioned. This provides the bottom panel along the lower portion of the box even when the tab is extended, such that the plastic or foil pouch within the box is not exposed when the tab is extended.

Figure 6:
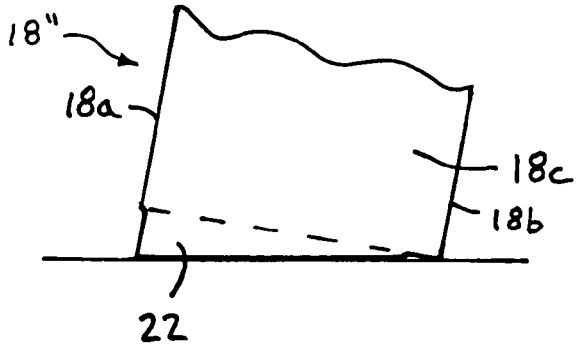
FIG. 6 is a side elevation of a lower portion of another container of the present invention, with side tabs along the opposite side walls of the container to tilt the container rearward.

Although shown and described as having a tab that extends downward from the front panel of the angulated box, it is envisioned that an angled box 18" (FIG. 6) may also or otherwise have a generally wedge-shaped or triangular-shaped tab 22 that is positioned along the lower edge of each of the opposite side panels or walls 18*c* of the box. The wedge-shaped tabs 22 may be initially positioned along the underside panel of the box and may be folded out when the box is positioned on a shelf to provide the rearward tilt or angling of the box as shown in FIG. 6. Optionally, an angulated box of the present invention may include both the front tab and the side tabs to define an angled skirt around the lower edges of the box to provide a more finished appearance to the box when it is positioned on a shelf, without affecting the scope of the present invention. The side skirts or tabs may be removably attached to the lower sides of the box, and may be removed therefrom, such as via tearing along a perforated line or the like, similar to the front tab described above.

Optionally, and as shown in FIGS. 2–4, angulated box 18 may include a rear tab or support 24 that may extend rearwardly from the rear panel 18*b* of box 18 to support box 18 and limit or substantially preclude rearward tipping of the box when it is placed on the shelf and angled rearwardly as shown in FIGS. 3 and 4. Similar to front tab 20, rear tab 24 may be initially positioned or folded along the bottom panel 18*e* of the box 18 (as shown in FIG. 2), and then may be unfolded (as shown in FIG. 4) to its rearward extending orientation to support the box on the shelf. When two or more rows of boxes are nested together (as shown in FIG. 4) the front tab 20 of a rearwardly positioned row of boxes may be positioned generally on top of rearward extending tab 24, such that the front face of the rearward positioned box may be generally adjacent to or up against the rear face of the forwardly positioned box. The boxes thus may be nested together to minimize the space taken up by multiple boxes on the shelves. Similar to the front and/or side tabs, the rear tab may be removable from the lower rear edge of the box, such as via tearing along a perforated line or the like, such as described above.

Figure 7:
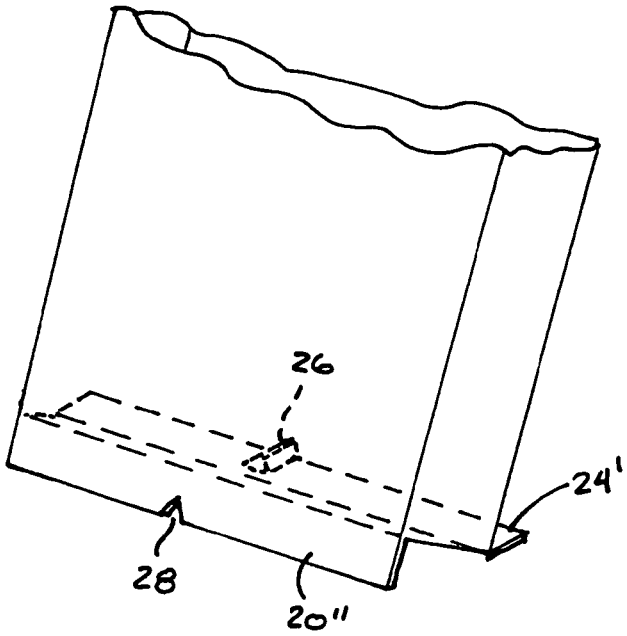
FIG. 7 is a perspective view of a portion of another container of the present invention, showing an alignment tab and notch for aligning the containers when they are nested together.

Optionally, and as shown in FIG. 7, a rear tab or support 24' may comprise or include a raised ridge or tab or alignment member 26 extending at least partially along a portion of the tab 24', while the front tab or skirt 20" may include a correspondly formed notch 28. When the boxes are nested together, the raised ridge 26 of a forwardly positioned box may be received within the correspondly formed notch 28 in a rearwardly positioned box, so as to maintain alignment of the nested boxes and to further limit or substantially preclude relative movement of the boxes to maintain the boxes in the desired position on the shelf. The boxes thus may be readily nested together and tilted or angled on the shelves to provide enhanced viewing of the boxes. Because the boxes may be maintained in general alignment with one another, the boxes that are positioned rearwardly or forwardly from other rows of angled boxes may not extend laterally toward one side or the other of the forwardly positioned boxes, such that the ends of the rows of boxes may be substantially aligned. Because the ends of the rows of angled boxes may be aligned, other conventional or non-tilted boxes (or boxes tilted at a different angle than the aligned angled boxes) may be positioned adjacent to and may abut against the rows of the angled boxes to minimize the space taken up by the boxes on the shelves.

Figure 8:
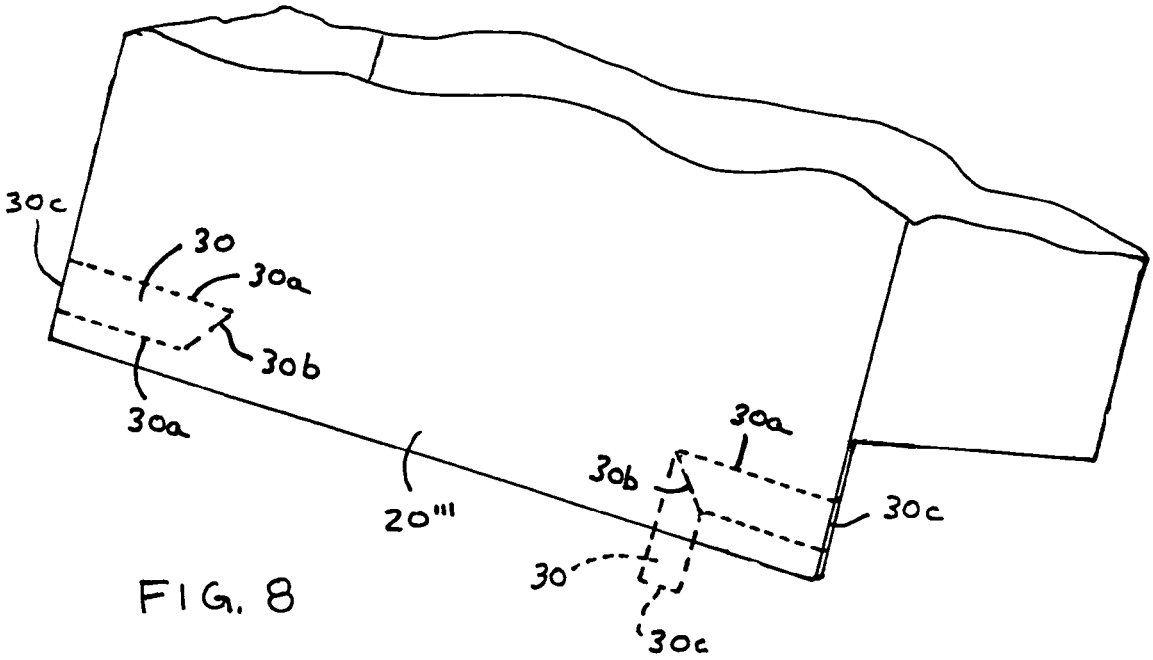
FIG. 8 is a perspective view of a lower portion of another container of the present invention, showing adjustable extensions or tabs that may be folded to further tilt the container if desired.

Optionally, and as shown in FIG. 8, a front tab 20''' may include an integral extension 30 that may be foldable relative to the box and the tab or skirt or front panel to further raise the front panel 18*a* of the box upward relative to the shelf to further tilt the box upwardly and/or rearwardly if desired. In the illustrated embodiment of FIG. 8, the extension 30 is defined along the face of tab 20''' via a pair of generally parallel perforated lines or slots 30*a* extending laterally partially along the tab 20''' and at the opposite lateral ends of the tab 20'''. As can be seen in FIG. 8, the parallel slots or perforated lines 30*a* are different lengths, so as to define an angled fold line 30*b* at the inward end of the extensions 30. When the extensions are desired to be used, the tab 20''' may be cut or torn along the perforated lines 30*a* and then folded along the fold line 30*b*, such that the extensions 30 extend rearwardly from the tab 20''' and downwardly below a lower edge of the tab 20'''. Because the fold line 30*b* is angled as shown in FIG. 8, the extension 30 folds downward when folded rearwardly or forwardly so as to extend below the lower edge of tab 20''' with a lower edge 30*c* resting on the support surface. The extension 30 thus may raise tab 20''' above the shelf surface to provide further tilting of the box if desired.

Figure 9:
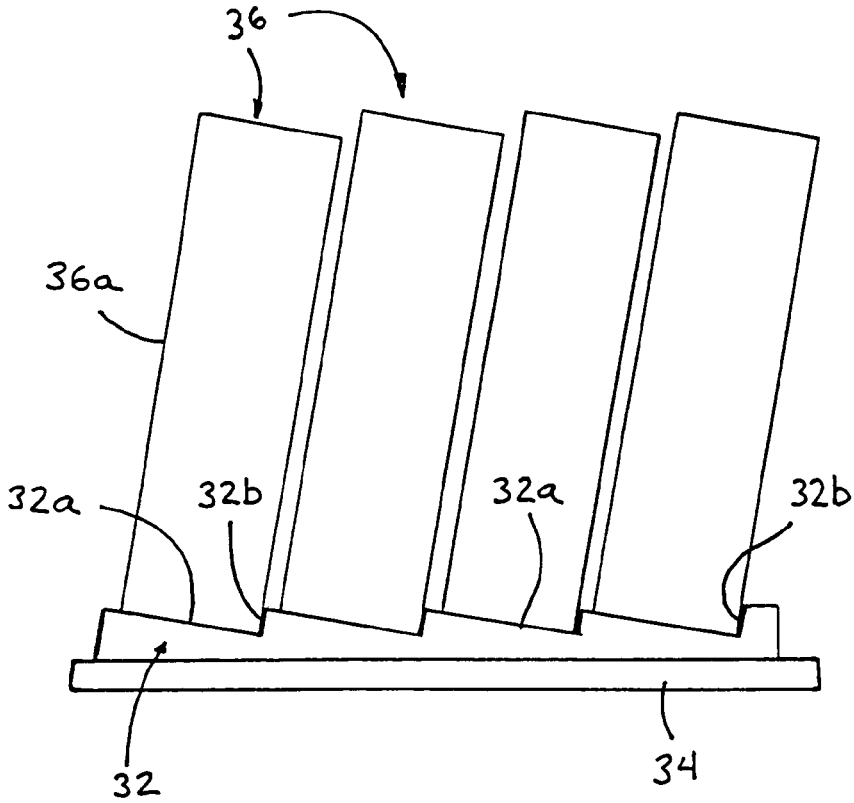
FIG. 9 is a side elevation of a plurality of containers that are positioned on an angling device to tilt or angle the containers relative to the support surface or shelf in accordance with the present invention.

Optionally, the angling or viewing system of the present invention may provide a means for supporting a generally rectangular box in a tilted orientation to enhance viewing of the boxes or packages or containers. For example, and with reference to FIG. 9, an angled base or holding or support device or tray or insert 32 may be positioned on a support 34, such as a generally horizontal support surface or shelf, and may include one or more angled or stepped support surfaces 32*a* for supporting one or more boxes or packages 36 in an angled or tilted manner. In the illustrated embodiment, each support surface 32*a* is adjacent to an angled back surface 32*b*, such that a box positioned on the support surface will be retained thereon by the back surface 32*b*, which limits or substantially precludes sliding or moving of the box downward along the support surface 32*a*. The angled base or holding device or tray 32 thus may hold a generally rectangular box or package or container in an angled or tilted orientation, such that the forward face 36*a* of the box may be angled generally upwardly to enhance viewing of the box. Optionally, the angled base may be reversed to angle the boxes generally downwardly, such as may be desired when the boxes and base are positioned on an upper or elevated support, such as a shelf or the like that is above eye level.

Figure 10:
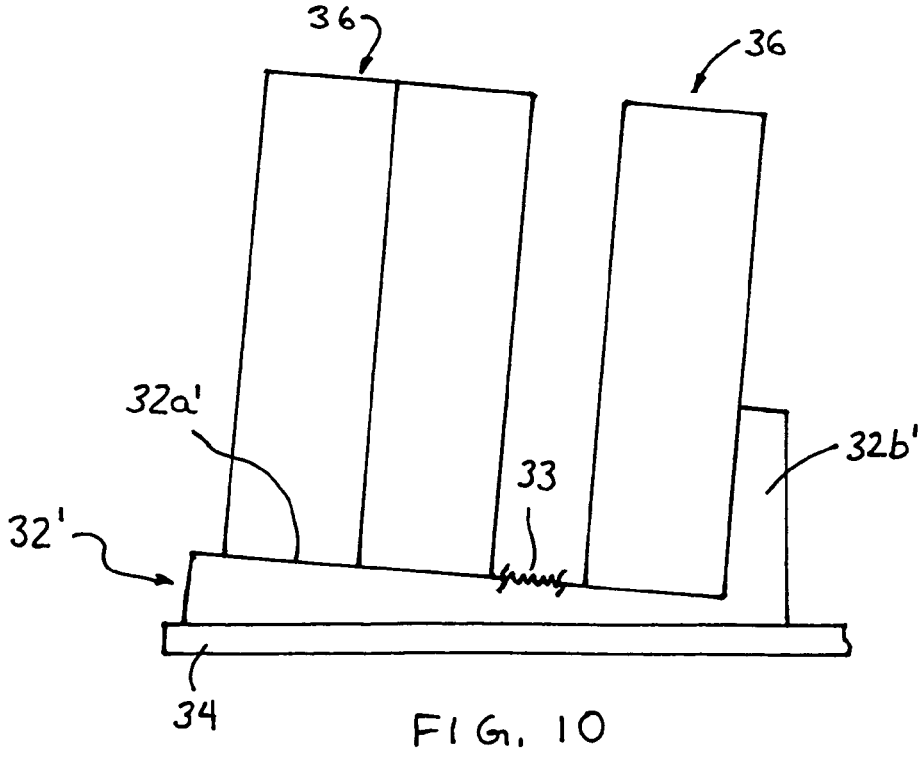
FIG. 10 is a side elevation of a plurality of containers positioned on another angling device in accordance with the present invention.

Optionally, and with reference to FIG. 10, an angled support surface insert or tray 32' may include a single angled support surface 32*a*' for supporting a plurality of containers or boxes 36 at an angle relative to the generally horizontal support or shelf 34. The support surface 32*a*' may be generally flat or may include ridges or bumps or texturing (as shown generally at 33 between two of the boxes) for engaging the lower surface and/or rear corner or edge of the boxes and limiting movement of the boxes along the inclined or angled support surface 32*a*'. The support tray 32' may include a raised rear wall portion 32*b*' for the innermost container or box to be moved against to limit further movement of the box along the inclined support surface 32*a*'. Because the inclined support surface of the angled support insert or tray 32' is generally continuous, multiple containers or boxes of various sizes may be placed on the insert. The insert thus provides a generic support that is not customized for boxes having a particular size or shape.

The present invention thus provides an angled container box or package that may be angled when positioned on a support or shelf such that the front face of the container is directed partially upwardly toward the ceiling lights of the store to enhance reflectivity and viewing of the front face of the container. Because the front faces of the angled containers are facing at least partially toward the overhead lighting, the angling of the containers makes the containers look brighter so that they stand out from the other non-tilted or conventional boxes on the shelf. The angled container of the present invention thus may provide for enhanced impulse buying of the product contained in the angled container because the container or containers will stand out from the other containers or boxes on the shelves. Optionally, the front face of the container may have a reflectant coloring or the like to further enhance the reflectivity and viewing, or may have a holograph formed thereon that may change as the viewing angle of the container changes to further enhance the viewing of the container and to further differentiate the angled containers from the other containers or boxes on the shelves.

For containers or boxes positioned on upper shelves that are above a particular level, such as above an eye level of a person or typical person shopping at the store, the angled containers and/or a tray supporting the containers may be reversed so that the outwardly facing wall or face of the container is directed generally downward toward the people below, in order to enhance viewing of the containers positioned on the upper shelves as well. Optionally, it is envisioned that the front and rear faces of the containers of the present invention may have substantially the same print or graphics thereon so that the containers may be readily reversed depending on which shelf they are placed on (such as depending on what level of the shelf or height of the shelf they are placed on). For example, if the containers are placed on a lower shelf or support, the containers may be angled rearwardly, so that the front or viewing faces of the containers are angled upwardly toward the light source to enhance viewing of the containers. If the containers are placed on an upper shelf or support above the typical eye level of a consumer, the containers may be angled forwardly, so that the viewing faces of the containers are angled downwardly toward the consumer's eye level to enhance viewing of the containers.

Because the tabs or skirts may be pivoted out from the lower panel of the box, the boxes may be initially packaged in large containers for shipping, whereby the tabs or skirts do not take up any additional space (over conventional rectangular boxes) in the large shipping containers. The boxes thus may be readily packaged in large shipping containers in a similar fashion as conventional boxes. When the packaged boxes arrive at the store, a person stocking the shelves with the boxes may pick up the box from the shipping container and unfold the tabs or flip the tabs out or otherwise extend the tabs to their extended position or orientation along the front face and/or side panels of a box, whereby the angled boxes may be placed on the shelves in their appropriate and desired angled or tilted orientation. After a consumer purchases the package, the tabs may be folded back under the box or removed from the box, so that the box may stand generally upright on the shelf or counter top at the consumer's home.

Although shown and described as generally rectangular boxes, it envisioned that the display system and method of the present invention may be equally applicable to other containers for holding products, such as plastic bottles or the like, in order the enhance the display and viewability of the other types of containers. Optionally, for example, a top facing container, such as a container or box with the top essentially open and generally parallel to the support or shelf that it rests on and facing generally upward toward the ceiling, may include a skirt or tab or tabs along a lower edge of the rear panel of the top facing container (or along the side panels), such that the container may be angled partially forwardly to enhance viewing of the container in a similar manner as described above. Such a top facing angulated container or box may be particularly suitable for holding candy bars or gum or the like, which are often positioned on angled shelves in a store. The angulated top facing containers of the present invention may function to further tilt or angle the containers to enhance the display of the products contained within the top facing containers. Because the top facing containers of the present invention are angled more toward the eyes of the consumer, the top panel of the containers may reflect the ceiling light more directly toward the customer rather than toward the ceiling, and thus, may enhance the viewing of the containers.

Optionally, it is further envisioned that aspects of the angled display system of the present invention may be applicable to packages or containers that hang from supports, such as arms or pegs or rods or the like, on a wall or panel in a store. Typically, such packages are in the form of cardboard cards or panels or the like with a header portion having a hole therethrough for receiving the peg. The card thus hangs generally straight down from the peg. A pegboard card of the present invention may include a spring-like or biasing extension or tab protruding or extending partially through or across the hole in the header portion of the card. The tab may engage the peg when the peg is inserted through the hole and may flex and brace against the peg or rod to cause tilting or angling of the package hanging from the peg or rod. For example, the tab may be positioned along a lower portion of the opening and may extend slightly rearwardly when the rod is received through the opening. The tab may push against the rod because the tab may be biased towards an initial position generally parallel to the card or header portion, such that the tab may cause an upward angling of the package or container to enhance viewability and reflectivity of the front surface of the container, in a similar manner as described above. Optionally, the tab and/or card may be reversed to cause a downward angling of the package to provide enhanced viewing of the package when it is positioned or hung above eye level.

Figure 11A:
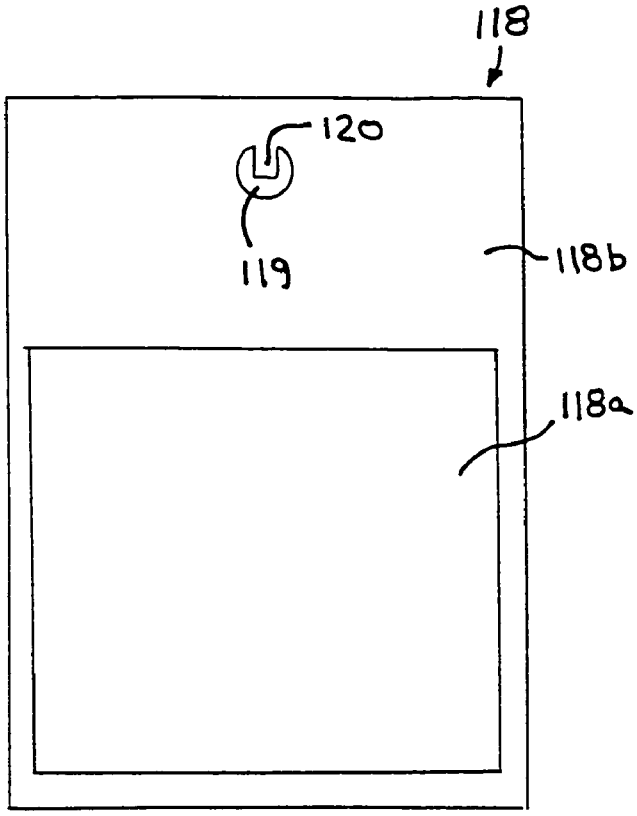
FIG. 11A is a front elevation of a hanging container with an angling tab in accordance with the present invention.
Figure 11B:
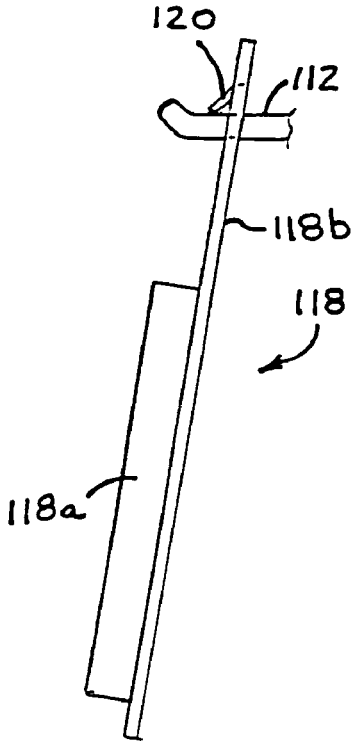
FIG. 11B is a side elevation of the hanging container of FIG. 11A.

For example, and with reference to FIG. 11A, a container 118 may include a container portion or bubble or package 118*a* (that may hold or contain a product therein, such as a tube of adhesive or other products typically packaged and sold in such bubble type containers) and a header portion 118*b* that has an aperture or hole or opening 119 therethrough. A tab or extension 120 may extend partially across the aperture 119 and may be biased toward a position generally along or parallel to the header portion 118*b*. When the container is displayed at a store, the aperture 119 receives a peg or rod or hook or support or projection 112 therethrough to hang the container at a desired location in the store. When the peg 112 is inserted through the aperture 119, the tab 120 may flex outwardly (as shown in FIG. 11B) and may be biased toward its position along the header. The biasing tab 120 thus may impart or exert a biasing force on the header portion and/or container to cause the container to pivot or angle upwardly (as can be seen in FIG. 11B) to provide enhanced viewability of the container relative to other known or conventional card packages.

Figure 11C:
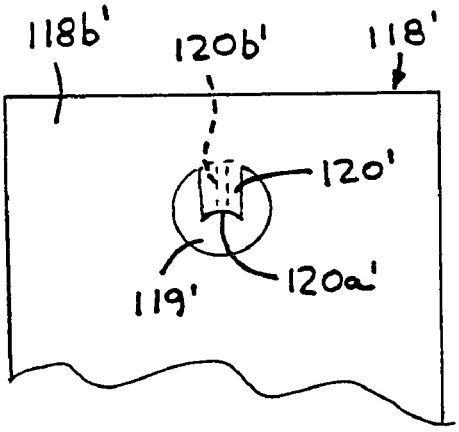
FIG. 11D is an enlarged view of another angling tab for a hanging container of the present invention.
Figure 11D:
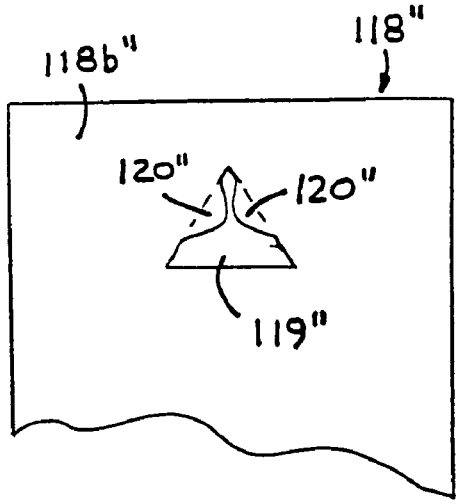

As shown in FIG. 11C, a tab 120' extending partially across an aperture 119' of a header portion 118*b*' of a package or container 118' may include a curved lower end 120*a*' to generally correspond to the rounded shape of the peg or protrusion that is received through the aperture. The tab or tabs may include an indentation or corrugation or rib 120*b*' to enhance the strength or rigidity or biasing force of the tab, or the tab may include hinges or creases to allow for flexibility during mounting of the container on the peg. The aperture may comprise a generally circular aperture with a downward depending tab, or the aperture may have another shape, with one or more tabs protruding partially across the aperture and flexing and biasing the container toward the desired viewing angle. For example, and as shown in FIG. 11D, an aperture 119" of a header portion 118*b*" of a package or container 118" may be generally triangular-shaped, and a tab 120" may extend from two of the sides of the aperture to bias the container. Other sized and shaped tabs or skirts or the like may be implemented with other types of containers to provide for the enhanced viewability and reflectivity of the front or upper surfaces of product containers in the manner described above, without affecting the scope of the present invention.

Therefore, the present invention provides a display system and method for the displaying product packages or containers that provides for enhanced viewing of a front face of an angulated or tilted package or container or box positioned on a support, such as a shelf or rod, relative to conventional, generally vertically oriented containers positioned on the shelf or rod next to the angulated containers of the present invention. The angulated containers are angled or tilted so as to be directed partially upward to enhance the reflectivity of the light off of the front faces of the containers, in order to enhance or brighten the front faces of the containers for enhanced viewing by a person looking at the containers on the supports. The front faces of the angulated containers thus may function to reflect the illumination from the ceiling lights generally toward the eye level of the customers shopping in the store to enhance the brightness and appearance of the angulated containers and to make the angulated containers stand out from the other conventional packages or boxes on the shelves.

Because the containers are angled partially upward toward the ceiling lights, the containers provide a spotlight effect by reflecting a greater amount of light toward the viewer, such that the faces of the containers appear as though a spotlight is on them and, thus, enhances the viewability of the containers to the customers in the store. Also, the angulated containers of the present invention, when positioned on an upper or higher support above a particular level or typical eye level height, may be reversed so as to be angled forwardly and partially downwardly to again enhance viewing of the containers on the upper supports above the person's eye level. The planar variation of the angled or tilted packages helps them stand out from the substantially uniform planes of the other conventional boxes or containers on the supports or shelves. Because the angulated containers may stand out from the other packages or boxes on the supports, the present invention may provide for enhanced sales of the products packaged within the angulated containers by increasing the likelihood of an impulse purchase by a customer that is walking along the aisles of the stores.

Changes and modifications in the specifically described embodiments may be carried out without departing from the principles of the present invention, which is intended to be limited only by the scope of the appended claims as interpreted according to the principles of patent law.

The embodiments of the invention in which an exclusive property or privilege is claimed are defined as follows:

1. A product display system for displaying product packages, said product display system comprising:

at least one generally horizontal support;

at least one illumination source positioncd substantially above said generally horizontal support and operable to illuminate said support; and a plurality of tilted product packages positioned on said support, said tilted packages comprising tilted boxes having a generally flat front face, a rear wall opposite said front face, opposite side walls, an openable top and a bottom opposite said top, said tilted boxes being arranged adjacent other tilted boxes such that opposed side walls of said adjacent tilted boxes generally abut one another, said tilted boxes being arranged in at least two rows with a front row being viewable by a person viewing said tilted boxes and a rear row being substantially nested behind said front row, said tilted boxes being tilted such that said front face of at least some of said tilted boxes faces at least partially toward said illumination source to provide enhanced illumination of said front face of said at least some of said tilted boxes; and a plurality of non-tilted boxes positioned on said generally horizontal support, said non-tilted boxes being generally vertically oriented or non-tilted, such that a front face of each of said non-tilted boxes is generally vertical, said non-tilted boxes being arranged on said support at or near said tilted boxes whereby said at least one illumination source provides enhanced illumination of said front faces of said tilted boxes as compared to the illumination of said front faces of said non-tilted boxes.

2. The display system of claim 1, wherein said tilted boxes include at least one tab extending generally downwardly from one of said front face and said opposite side walls, said at least one tab raising said front face of said tilted box upward above the support such that said tilted box is tilted.

3. The display system of claim 2, wherein said plurality of tilted boxes are arranged in rows on said support, with the rows of said tilted boxes being nested together with said front faces of a rearward row of said tilted boxes being generally adjacent to said rear walls of a forward row of said tilted boxes.

4. The display system of claim 1, wherein said tilted packages include at least one tab extending generally downwardly from a forward portion of said package, said at least one tab raising said front face of said tilted package upward above the support such that said tilted package is tilted.

5. The display system of claim 4, wherein said at least one tab includes at least one slot or perforated segment extending laterally along a portion of said tab, said slot or perforated segment defining a tab extension, said tab extension being selectively foldable relative to the rest of said tab to provide additional raising of said front face.

6. The display system of claim 4, wherein said at least one tab is removably attached to said tilted package.

7. The display system of claim 1 including at least one elevated support positioned above said at least one generally horizontal support, said at least one elevated support supporting a plurality of downwardly tilted product packages, said downwardly tilted product packages on said at least one elevated support being tilted such that a front face of at least some of said downwardly tilted product packages face outwardly from said elevated support and at least partially downward toward a person viewing said product packages.

8. The display system of claim 1, wherein each of said tilted packages includes a rear tab extending and rearwardly from a lower end of a rear wall of said tilted package.

9. The display system of claim 8, wherein said rear tab includes an alignment tab extending generally upward therefrom and said tilted package includes an alignment notch for receiving said alignment tab when said tilted packages are nested together on said support.

10. The display system of claim 1, wherein said tilted packages receive sealed containers therein, said sealed containers containing the product.

11. The display system of claim 10, wherein said sealed containers contain one of toothpaste, cookies, crackers, cereal and cooking mixes.

12. The display system of claim 1, wherein said front face has a picture thereon and text indicative of the product contained therein, said tilted package providing enhanced visibility of said picture and said text when said tilted package is tilted at least partially toward said illumination source.

13. The display system of claim 1, wherein said generally horizontal support comprises a support shelf.

14. The display system of claim 13 including an angled package support positioned on said support shelf, said angled package support having at least one angled support surface that is angled relative to said support shelf, said at least one angled support surface supporting at least one package in a tilted orientation.

15. The display system of claim 14, wherein said angled package support includes an angled stop surface extending generally normal to said angled support surface to limit downward movement of said at least one package along said angled support surface.

16. The display system of claim 1, wherein said generally horizontal support comprises a support arm that is received through an aperture in said tilted package, said tilted package including a tab that biases said tilted package toward a tilted orientation when said aperture receives said support arm.

17. A product display system for displaying product packages, said product display system comprising:

at least one generally horizontal support;

at least one illumination source positioned substantially above said generally horizontal support and operable to illuminate said support;

a plurality of tilted product packages positioned on said support, said tilted packages being tilted such that a front face of at least some of said tilted packages faces at least partially toward said illumination source to provide enhanced illumination of said front face of said at least some of said tilted packages, said tilted packages comprising tilted boxes having said front face, a rear wall opposite said front face, opposite side walls, an openable top and a bottom opposite said top; and wherein said tilted boxes include at least one tab extending generally downwardly from one of said front face and said opposite side walls, said at least one tab raising said front face of said tilted box upward above the support such that said tilted box is tilted, wherein at least one upper tilted box is stacked on top of at least one lower tilted box, said at least one tab of said upper tilted box extending downward over said front face of said lower tilted box to limit rearward movement of said upper tilted box relative to said lower tilted box.

* * * * *